US009290928B2

(12) United States Patent
Klein

(10) Patent No.: US 9,290,928 B2
(45) Date of Patent: Mar. 22, 2016

(54) HEADER AND SILL CONNECTOR CLIPS AND RELATED WALL ASSEMBLIES

(71) Applicant: James Alan Klein, Bellevue, WA (US)

(72) Inventor: James Alan Klein, Bellevue, WA (US)

( * ) Notice: Subject to any disclaimer, the term of this patent is extended or adjusted under 35 U.S.C. 154(b) by 0 days.

(21) Appl. No.: 13/717,485

(22) Filed: Dec. 17, 2012

(65) Prior Publication Data

US 2014/0000213 A1 Jan. 2, 2014

Related U.S. Application Data

(60) Provisional application No. 61/630,557, filed on Dec. 15, 2011.

(51) Int. Cl.
*E04B 1/38* (2006.01)
*E04B 1/41* (2006.01)

(52) U.S. Cl.
CPC ..... *E04B 1/40* (2013.01)

(58) Field of Classification Search
USPC ..... 52/698, 712, 715, 204.1, 656.1, 656.2, 52/656.4, 656.5, 656.6
See application file for complete search history.

(56) References Cited

U.S. PATENT DOCUMENTS 2,235,761 A * 3/1941 Goldsmith ..... 52/292
2,413,362 A * 12/1946 Maxwell et al. ..... 403/403
3,001,615 A * 9/1961 Ries ..... 403/230
3,188,696 A * 6/1965 Earhart ..... 52/241
5,186,571 A * 2/1993 Hentzschel ..... 403/231
5,625,995 A * 5/1997 Martin ..... 52/715
5,839,848 A * 11/1998 Sahramaa ..... 403/382
5,904,023 A * 5/1999 diGirolamo et al. ..... 52/712
5,906,080 A * 5/1999 diGirolamo et al. ..... 52/243.1
6,088,982 A * 7/2000 Hiesberger ..... 52/241
6,430,890 B1 * 8/2002 Chiwhane et al. ..... 52/715
6,568,144 B2 * 5/2003 Meredith ..... 52/656.1
6,609,344 B2 * 8/2003 Saldana ..... 52/696
6,640,516 B1 * 11/2003 Thompson ..... 52/712
6,799,407 B2 * 10/2004 Saldana ..... 52/712
6,837,019 B2 * 1/2005 Collie ..... 52/712
7,021,021 B2 * 4/2006 Saldana ..... 52/696
RE39,462 E * 1/2007 Brady ..... 403/230
7,216,465 B2 * 5/2007 Saldana ..... 52/655.1
7,461,494 B2 * 12/2008 Frezza ..... 52/846
7,533,508 B1 * 5/2009 diGirolamo et al. ..... 52/481.1
7,559,519 B1 * 7/2009 Dragic et al. ..... 248/300
7,621,096 B2 * 11/2009 Ellis ..... 52/712
7,856,763 B2 * 12/2010 Keys et al. ..... 52/92.2
7,882,676 B2 * 2/2011 Ellis ..... 52/712
8,011,160 B2 * 9/2011 Rice ..... 52/745.09
8,181,419 B1 * 5/2012 diGirolamo ..... 52/745.19
8,356,453 B2 * 1/2013 Rice ..... 52/745.09
8,413,394 B2 * 4/2013 Pilz et al. ..... 52/207
8,540,201 B2 * 9/2013 Gadd et al. ..... 248/300
8,555,592 B2 * 10/2013 Daudet et al. ..... 52/489.1

(Continued)

*Primary Examiner* — William Gilbert
*Assistant Examiner* — Gisele Ford
(74) *Attorney, Agent, or Firm* — Thomas E. Loop

(57) ABSTRACT

A connector clip configured to interconnect a sill member to a stud within a sheet-metal wall assembly is disclosed herein. The innovative connector clip comprises: a piece of sheet-metal that defines a planar web; and at least a first web flange perpendicular to the web. The innovative connector clip may be characterized in that the web includes at least a first transverse web slot positioned for receiving a first sill flange of the sill member when the sill member is positioned adjacent to one of the ends of the stud, and wherein the first transverse web slot defines a right angle with the first web flange.

3 Claims, 4 Drawing Sheets

(56) References Cited

U.S. PATENT DOCUMENTS

2002/0170260 A1* 11/2002 Wheeler et al. ..... 52/656.1
2002/0189174 A1* 12/2002 Thompson ..... 52/92.2
2003/0029124 A1* 2/2003 Wise ..... 52/712
2003/0093969 A1* 5/2003 Saldana ..... 52/715
2006/0096233 A1* 5/2006 Nystrom ..... 52/712
2009/0113839 A1* 5/2009 Carr ..... 52/712
2010/0050561 A1* 3/2010 Jafari ..... 52/712
2010/0146903 A1* 6/2010 Ellis ..... 52/696

* cited by examiner

HEADER AND SILL CONNECTOR CLIPS AND RELATED WALL ASSEMBLIES

CROSS-REFERENCE TO RELATED APPLICATIONS

This application claims the benefit of priority to U.S. Provisional Application No. 61/630,557, filed on Dec. 15, 2011, all of which application is incorporated herein by reference in its entirety for all purposes.

TECHNICAL FIELD

The present invention relates generally to building construction and, more particularly, to rigid reinforcement connector clips that are configured to interconnect studs to a header or sill member within a sheet-metal wall assembly, as well as to related wall assemblies.

BACKGROUND OF THE INVENTION

In the building construction industry, there is often a need to connect together (interconnect) a plurality of vertical studs to a horizontal header or sill such as, for example, during the construction of sheet-metal wall assemblies having doorway or window openings. In such wall assemblies, a horizontally positioned sheet-metal sill member is generally installed above a doorway or window opening, and a plurality of upwardly extending "kicker" studs are attached to the top portion of the sill member such that they extend upward to the ceiling (so as to define a section of the overall wall assembly). Consequently, and in order to facilitate the attachment of kicker studs to sill members, a number of specialty add-on "track" and "clip" components have been developed over the years as is known in the art. Exemplary in this regard is the ProX HEADER SYSTEM (inclusive of its related specialty track and clip components) sold by ClarkWestern Building Systems. The ProX HEADER SYSTEM is complex and expensive.

Therefore, and although some specialty connection components useful for interconnecting kicker studs to sill members within a wall assembly are known, there is still a need in the art for new and improved connector clips and related wall assemblies. The present invention fulfills these needs and provides for further related advantages.

SUMMARY OF THE INVENTION

In brief, the present invention in one embodiment is directed to a connector clip configured to interconnect a sill member to a stud within a sheet-metal wall assembly. The innovative connector clip comprises: a piece of sheet-metal that defines a planar web; and at least a first web flange perpendicular to the web. The innovative connector clip may be characterized in that the web includes at least a first transverse web slot positioned for receiving a first sill flange of the sill member when the sill member is positioned adjacent to one of the ends of the stud, and wherein the first transverse web slot defines a right angle with the first web flange.

These and other aspects of the present invention will become more evident upon reference to the following detailed description and attached drawings. It is to be understood, however, that various changes, alterations, and substitutions may be made to the specific embodiments disclosed herein without departing from their essential spirit and scope.

BRIEF DESCRIPTION OF THE DRAWINGS

In the drawings like reference numerals are used to designate like features throughout the several views of the drawings.

DETAILED DESCRIPTION OF THE INVENTION

Figure 7:
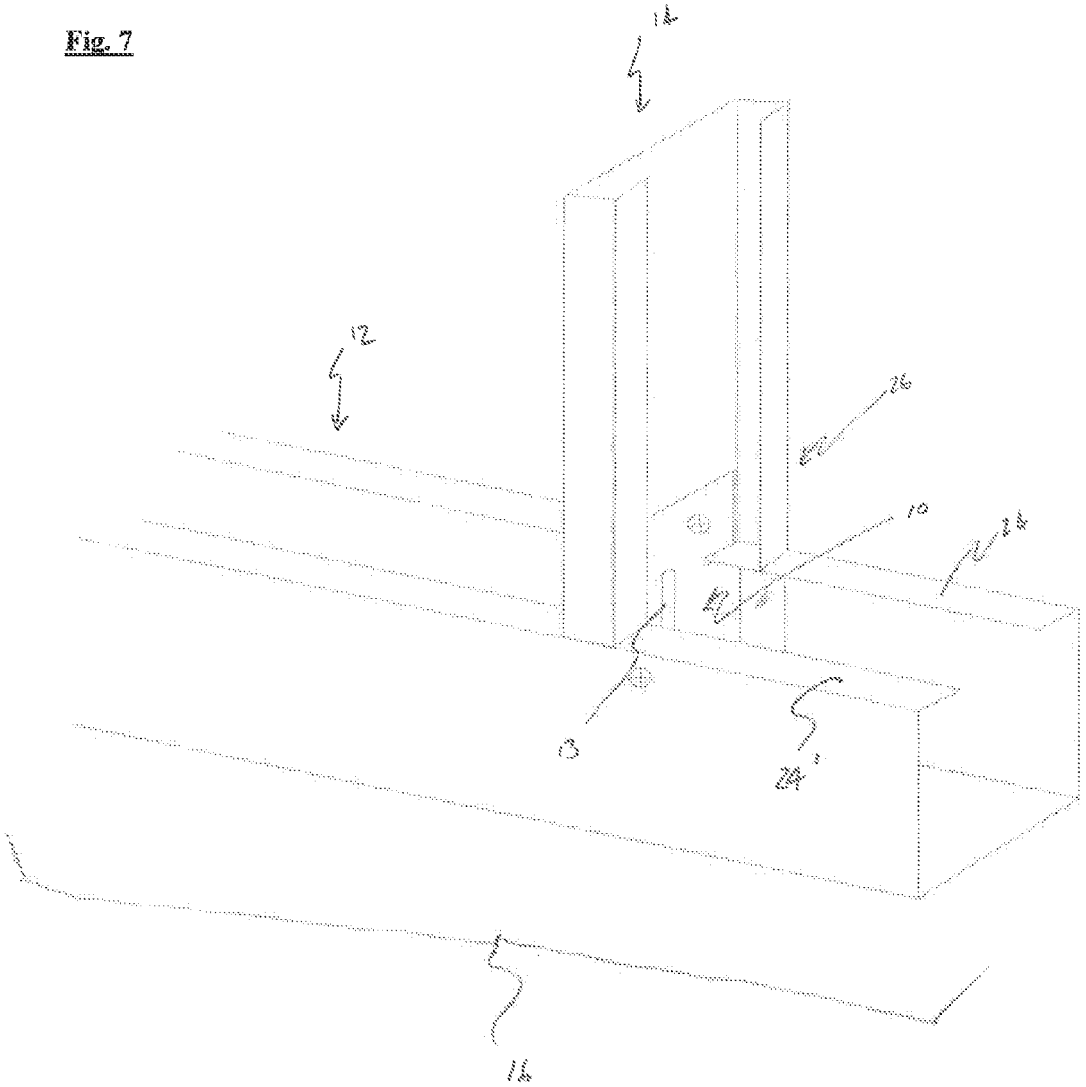
FIG. 7 is a side perspective view of a connector clip in accordance with the embodiment shown in FIG. 1, wherein the connector clip is positioned within a sill member and interconnected (by way of a plurality of fasteners such as, for example, a plurality screws) with an upwardly extending C-shaped kicker stud in accordance with an embodiment of the present invention.
Figure 8:
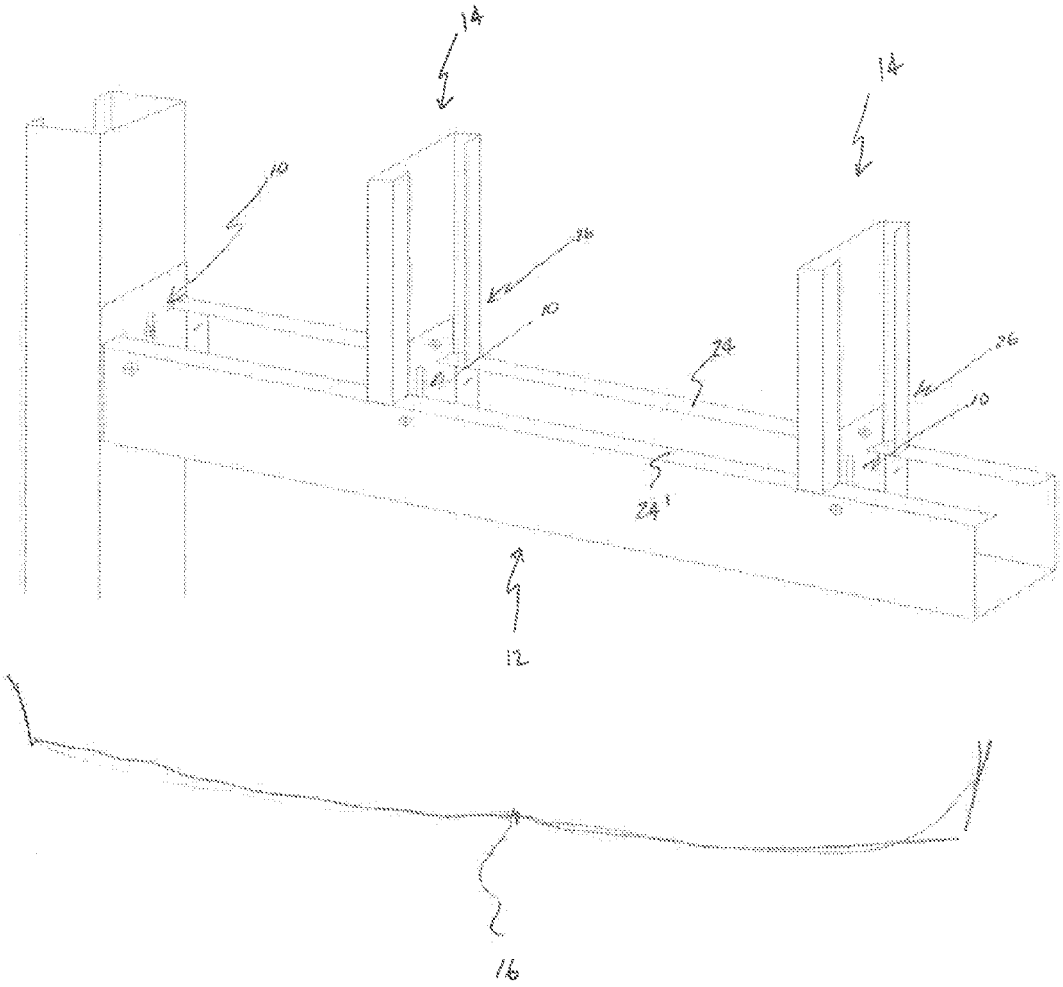
FIG. 8 is a side perspective partial view of a wall assembly that includes first, second, and third connector clips in accordance with an embodiment of the present invention.

Referring now to the drawings wherein like reference numerals are used to designate like features and, more particularly, to FIGS. 1-8, the present invention in an embodiment is directed to a connector clip 10 configured to interconnect a sill member 12 to a stud 14 within a sheet-metal wall assembly 16 (as best shown in FIG. 8). As best shown in FIGS. 1-5, the innovative connector clip 10 of the present invention comprises a piece of sheet-metal (of a selected gauge) that defines a planar web 18, and at least a first web flange 20 perpendicular (along one its side edges) to the web 18. The innovative connector clip 10 may be characterized in that the web 18 includes at least a first transverse web slot 22 positioned for receiving a first sill flange 24 of the sill member 12 when the sill member 12 is positioned adjacent to one of the ends 26 of the stud 14 (as best shown in FIG. 7). As best shown in FIGS. 1 and 3-5, the first transverse web slot 22 defines a right angle (90° degree angle) with the first web flange 20. In addition, the innovative connector clip 10 may further comprise a centrally positioned opening 13 through the web. The centrally positioned opening 13 facilitates the bending and positioning of the connector clip 10 into a cooperative relationship within the sill member 12.

Figure 1:
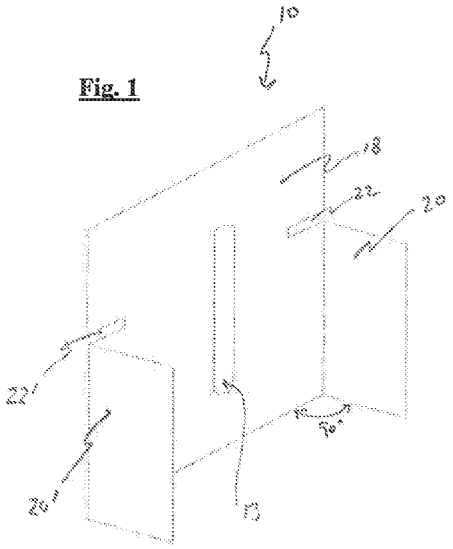
FIG. 1 is a side perspective view of a connector clip in accordance with an embodiment of the present invention, wherein the connector clip includes confronting first and second web flanges.
Figure 2:
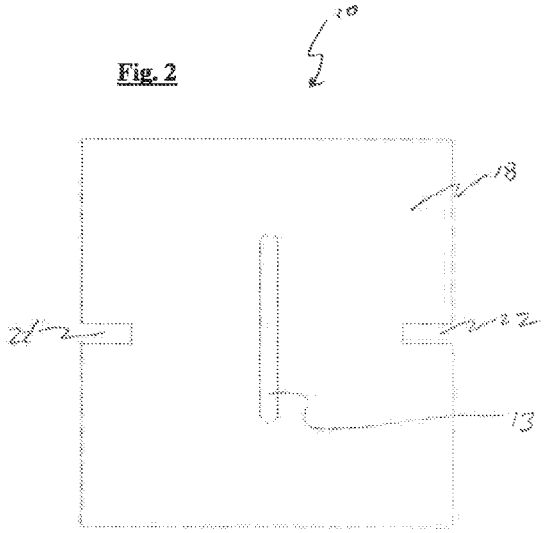
FIG. 2 is a side view of the connector clip shown in FIG. 1.

In another embodiment and as also best shown in FIG. 1, the innovative connector clip 10 may further comprise a second web flange 20' that is also perpendicular (90° degree angle) to the web 18. As shown, the second web flange 20' confronts and is generally parallel with the first web flange 20. Similarly, a second transverse web slot 22' is positioned for receiving a second sill flange 24' of the sill member 12 when the sill member 12 is positioned adjacent to one of the ends 26 of the stud 14 (as best shown in FIG. 7). The second transverse web slot 22' also defines a right angle (90° degree angle) with the second web flange 20'.

Figure 3:
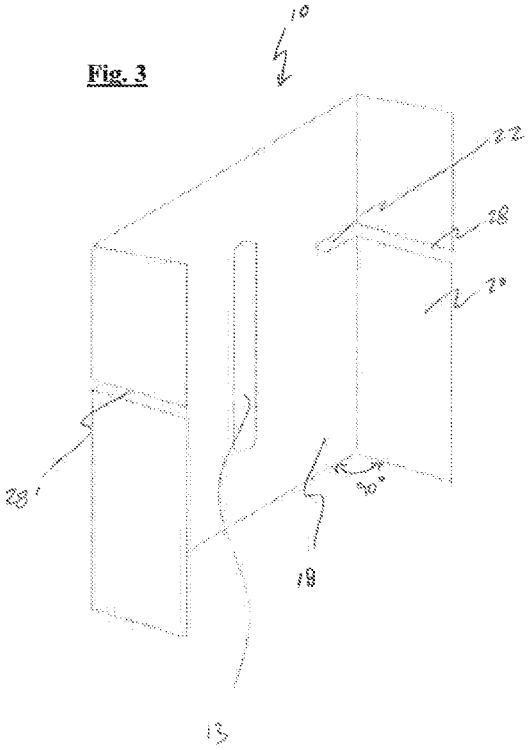
FIG. 3 is a side perspective view of a connector clip in accordance with another embodiment of the present invention, wherein the connector clip includes confronting first and second web flanges, and wherein the first and second web flanges further include first and second web flange slots (for engagement with respective inwardly directed first and second sill flanges of the sill).
Figure 4:
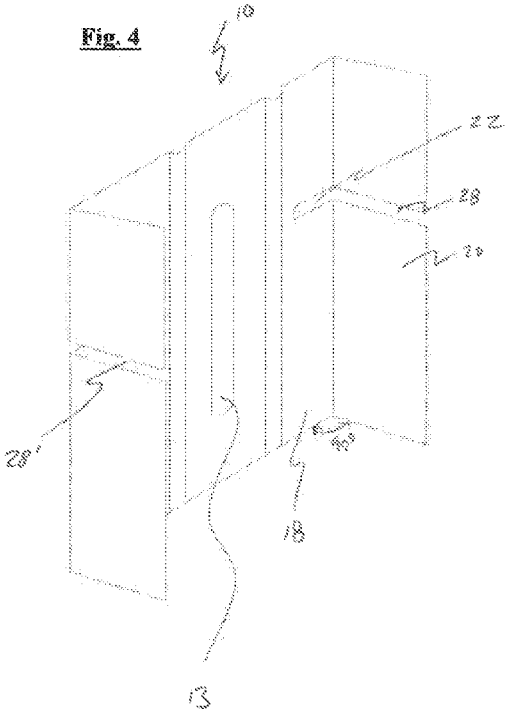
FIG. 4 is a side perspective view of a connector clip in accordance with yet another embodiment of the present invention (similar to the embodiment shown in FIG. 3, but further comprising a pair of vertically extending grooves that impart additional flexibility and strength).
Figure 5:
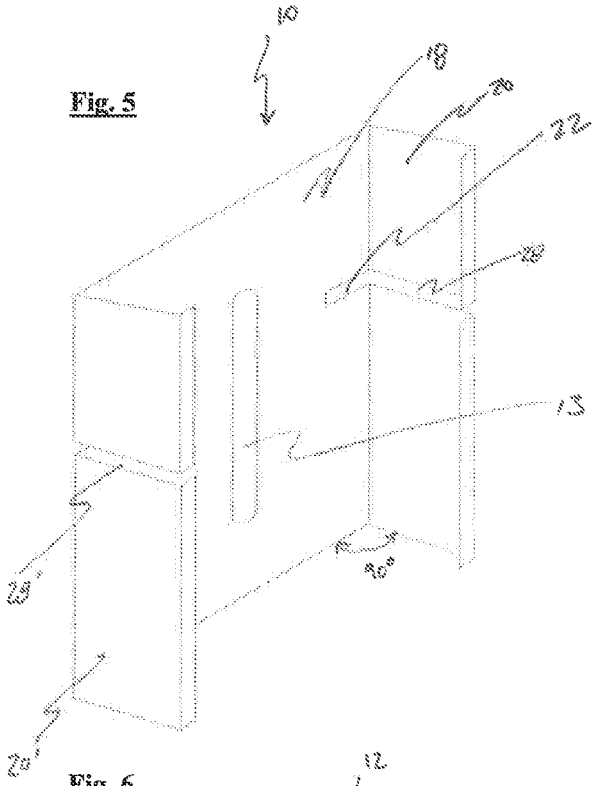
FIG. 5 is a side perspective view of a connector clip in accordance with still yet another embodiment of the present invention (similar to the embodiment shown in FIG. 3, but further comprising a pair of web flange returns that impart additional strength).
Figure 6:
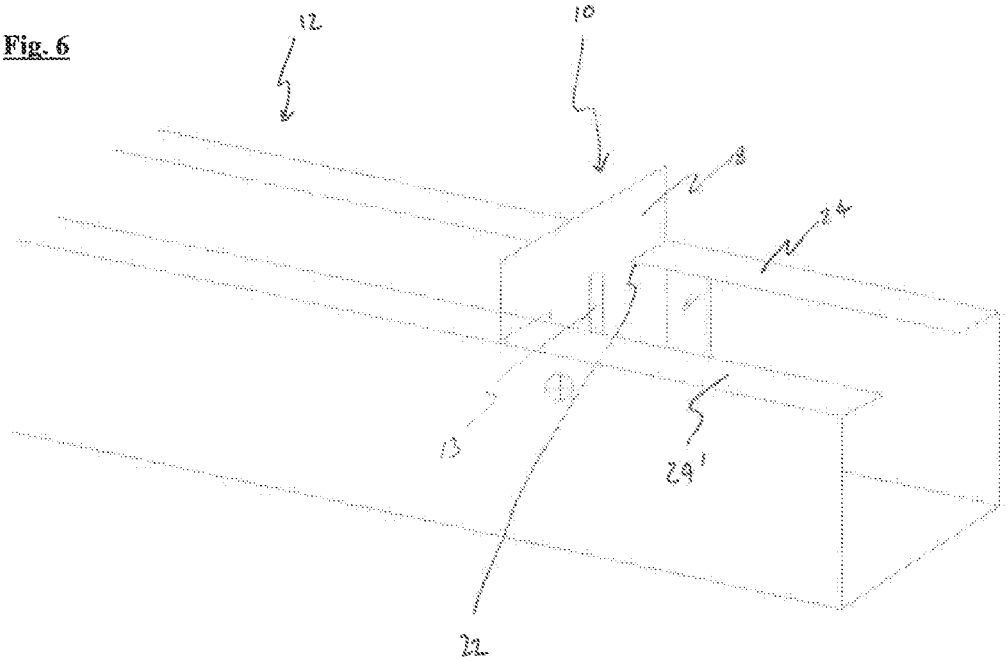
FIG. 6 is a side perspective view of a connector clip in accordance with the embodiment shown in FIG. 1, wherein the connector clip is positioned within a sill member and ready for connection to a kicker stud in accordance with an embodiment of the present invention.

In still further embodiments and as best shown in FIGS. 3-5, the first and second web flanges 20, 20' may each include respective first and second web flange slots 28, 28' that are continuous and coplanar with the respective first and second web slots 22, 22'. As shown, the first and second web flange slots 28, 28' are positioned for receiving respective the first and second sill flanges 24, 24' of the sill member 12 when the sill member 12 is positioned adjacent to one of the ends 26 of the stud 14 (as best shown in FIG. 7).

The present invention is also directed to a sheet-metal wall assembly 16 (FIG. 8) that comprises a horizontally positioned sill 12 interconnected to a plurality of upwardly extending studs 14, wherein a connector clip 10 interconnects at least one of the plurality of studs 14 to the sill 12, and wherein the connector clip 10 consists essentially of a piece of sheet-metal that defines a planar web 18 having first and second web flanges 20, 20' perpendicular to the web 18 and confronting each other. The sheet-metal wall assembly 16 is characterized in that the web 18 includes first and second transverse web slots 22, 22' engaged with respective inwardly directed first and second sill flanges 24, 24' of the sill 12.

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing description, and all changes that come within the meaning and range of equivalency of the claims are to be embraced within their scope.

What is claimed is:

1. In combination with a sheet-metal wall assembly, a connector clip interconnecting a horizontally positioned sheet-metal sill member to a vertically positioned sheet-metal stud within the sheet-metal wall assembly, wherein the sill member is C-shaped and has confronting and inwardly extending first and second sill flanges, comprising:

a bent piece of sheet-metal that defines a planar web;

a first vertically oriented web flange perpendicular to the web; and a second vertically oriented web flange perpendicular to the web, wherein the second web flange confronts and is parallel with the first web flange;

characterized in that the web includes first and second horizontally transverse web slots positioned for receiving the first and second sill flanges of the sill member when the sill member is positioned adjacent to and receives one of the ends of the stud, and wherein the first and second transverse web slots each defines a right angle with respect to the first web flange.

2. The connector clip according to claim 1, further comprising a centrally positioned opening through the web.

3. The connector clip according to claim 2 wherein the centrally positioned opening is an elongated vertically oriented slot that is substantially parallel to the first sill flange.

* * * * *